US006584984B2

(12) United States Patent
Kelly

(10) Patent No.: US 6,584,984 B2
(45) Date of Patent: Jul. 1, 2003

(54) PROTECTIVE HEADBAND

(76) Inventor: Paula L. Kelly, 1185 Bay Dr., Dixon, IL (US) 61021

( * ) Notice: Subject to any disclaimer, the term of this patent is extended or adjusted under 35 U.S.C. 154(b) by 34 days.

(21) Appl. No.: 10/004,550

(22) Filed: Dec. 4, 2001

(65) Prior Publication Data

US 2002/0129831 A1 Sep. 19, 2002

Related U.S. Application Data

(60) Provisional application No. 60/276,827, filed on Mar. 17, 2001.

(51) Int. Cl.[7] ..... A41D 13/00

(52) U.S. Cl. ..... 132/212; 132/273; 132/319; 2/174

(58) Field of Search ..... 132/273, 275, 132/212, 319; 2/174; D28/20, 41; D2/510

(56) References Cited

U.S. PATENT DOCUMENTS

| | | | | |
|---|---|---|---|---|
| 486,348 | A | | 11/1892 | Mattson |
| 1,524,863 | A | | 2/1925 | Houston |
| 1,741,327 | A | | 12/1929 | Merlino |
| 1,750,937 | A | | 3/1930 | Morgan |
| 2,032,898 | A | | 3/1936 | Wilson |
| 2,424,352 | A | | 7/1947 | Conjurske |
| 4,223,407 | A | | 9/1980 | Zappala |
| 4,368,545 | A | | 1/1983 | Seidman |
| 4,481,680 | A | | 11/1984 | Mason et al. |
| 4,638,512 | A | | 1/1987 | Frankel |
| D303,040 | S | | 8/1989 | Paone |
| D323,241 | S | | 1/1992 | Neal |
| 5,146,629 | A | | 9/1992 | Barnes |
| 5,175,887 | A | * | 1/1993 | Kim ..... 2/174 |
| 5,551,088 | A | | 9/1996 | Stepp |
| 5,797,141 | A | * | 8/1998 | Morlett ..... 2/174 |
| 5,857,218 | A | | 1/1999 | Kuhlman |
| 5,940,885 | A | | 8/1999 | Matthews |

* cited by examiner

*Primary Examiner*—Todd E. Manahan
(74) *Attorney, Agent, or Firm*—Keith Frantz

(57) ABSTRACT

A headband sized to wrap around a user's forehead and extend past the user's ears to prevent the dripping of hair treatments into a user's face and eyes. The headband includes a base band, a resilient seal band extending upwardly and inwardly from the base band, and a channel extending therebetween along the base band such that conditioner dripping down toward the user's forehead will flow across the seal band and into the channel whereupon the liquid will exit the channel behind the user's ears.

21 Claims, 6 Drawing Sheets

FIG. 6
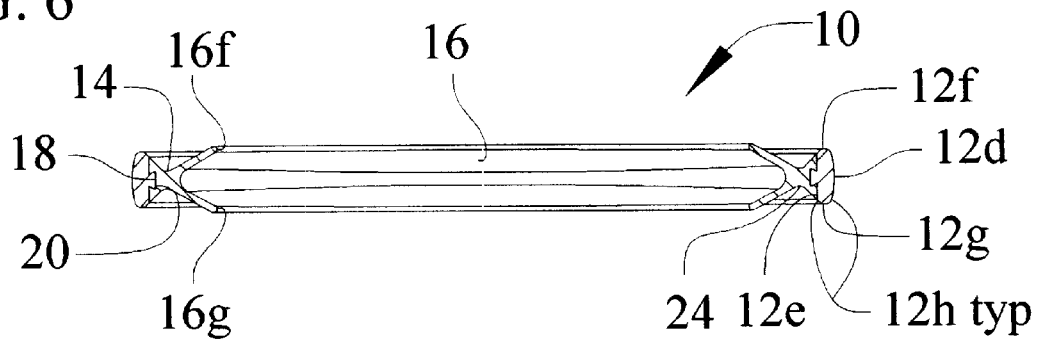
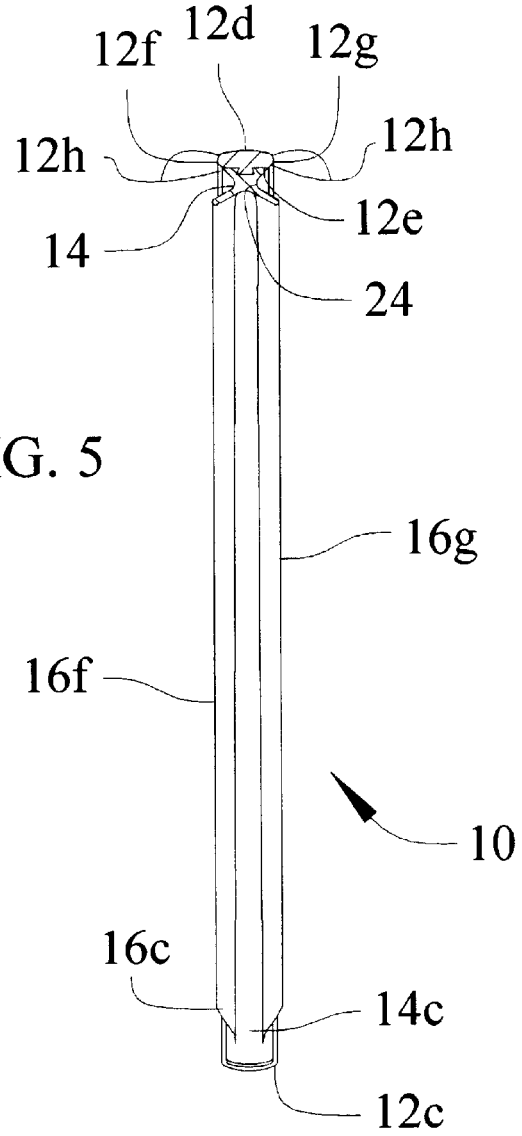
FIG. 5
FIG. 7
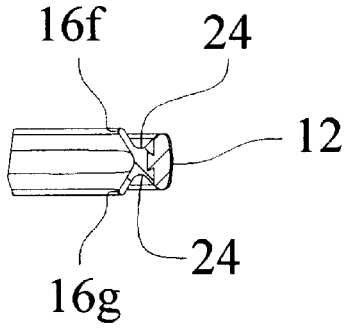

PROTECTIVE HEADBAND

CROSS-REFERENCE TO RELATED APPLICATIONS

This application claims the benefit of U.S. Provisional Patent Application Ser. No. 60/276,827 filed Mar. 17, 2001.

REFERENCE TO MICROFICHE APPENDIX

Not applicable.

STATEMENT REGARDING FEDERALLY SPONSORED RESEARCH OR DEVELOPMENT

Not applicable.

BACKGROUND OF THE INVENTION

1. Field of Invention

The present invention relates generally to apparatus for protecting a user's face and eyes from dripping, potentially irritating fluids during the application of hairdressing treatments.

More particularly, the invention relates to a compact, portable protective headband which, while suitable for other uses, is particularly useful in preventing the dripping of conditioner and other hair treatments into the user's eyes during the time the treatment remains on the user's hair, while permitting continued mobility of the user.

2. Description of Prior Art

Use of conditioner and other hair care treatments often results in residual runoff. This can be quite uncomfortable and irritating if the runoff drips into a person's face and eyes. Thus, it is desirable to re-direct this runoff away from the person's face. For personal use, such as in a bath or shower, it is desirable that the this residual runoff be re-directed away from the person's face while permitting the person to continue with other personal cleaning and hygiene-related activities.

A variety of devices for protecting a user's face and eyes from hairdressing treatments are known in the prior art. However, these devices suffer from certain drawbacks and disadvantages, particularly as concerning personal use where ease of use and continued mobility are desirable.

Kuhlman, U.S. Pat. No. 5,857,218, discloses a protective visor that includes a high-density foam bill attached to a soft foam headband intended to be secured with a clip connecting terminating ends of the headband just below the hairline at the back of the user's head. The Kuhlman device includes no positive guidance channel to carry dripping fluid away from the wearer's face. Instead, residual runoff is to be absorbed by the foam in the headband and visor. However, if the foam becomes saturated, the liquid can drip over the bill and the headband, and potentially into the user's eyes and face. And securing the Kuhlman visor snugly in place with a clip at the back of the head can be difficult without assistance.

Mason et al., U.S. Pat. No. 4,481,680; Wilson, U.S. Pat. No. 2,032,898; and Mattson, U.S. Pat. No. 486,348 disclose additional protective visors that encircle the user's head. The Mason device includes a crescent-shaped, planar, flexible brim adapted to be manually shaped into a channel to carry fluids to the back of the user's head, and a hook and loop connector at rear terminating ends to secure the band in position. The Wilson device utilizes a snap to connect the terminating ends at the back of the user's head. The Mattson device utilizes buckles to secure both a strap positioned around the user's head, and a second strap positioned over the top of the user's head from front to back. However, as with Kuhlman, such arrangements can be difficult to manipulate to a snug fit, requiring the user to manually fasten the device at the back of his or her head.

Wilson also discloses an alternate embodiment visor provided with eyeglass-type ear pieces for securing to the user's head. However, in this embodiment, as well as in the Mattson device, the fluid-carrying channel discharges forward of the user's ears for dripping down the side of the face. As a result, if the user's head tips, fluid can drip down the sides of the face and into the user's eyes.

Morgan, U.S. Pat. No. 1,750,937, discloses another protective device that is intended to protect only the user's eyes. However, the device carries dripping liquid past the front of a user's ears, and thus to a position where it could enter the user's ears.

Merlino, U.S. Pat. No. 1,741,327, discloses a visor provided with adjustable sponge ear plugs that fit into the user's ears for securing to the user's head. Although the ear plugs prevent liquid from entering into the user's ears, they can be uncomfortable for the user. And as with Wilson device and the alternate embodiment of Mattison, the fluid directing channel of the Merlino device discharges directly forward of the user's ears, and thus, presents the potential for fluid to enter the user's eyes. In response to this recognized deficiency, Merlino also discloses an alternate embodiment that includes goggles to protect the user's eyes.

Zappala, U.S. Pat. No. 4,223,407, discloses a molded protective visor with ear covers shaped to fit around the user's ears for securing the visor to the user's head. Such an arrangement does not readily accommodate differences in ear sizes and shapes, and it does not accommodate differences in relationship between ear size and hairline position. To provide for a sung fit on a large number of people, the Zappala device would need to be manufactured with a variety of size ear covers, as well as a variety of ear-size to hairline-position relationships, and the visor would need to be fitted to each person for their ear size and hairline position. In addition, the Zappala device is a relatively complex configuration. All of these factors result in a device that is relatively expensive to manufacture, and that is not readily adaptable for use by a variety of potential users.

Certain other prior devices are simply too large, are not portable, or otherwise not suitable for comfortable personal use, but are more suitable for use in a commercial setting where the motion of the user's head will be restricted. Conjurske, U.S. Pat. No. 2,424,352, discloses a shampoo splash-guard device provided with relatively large shade, adjustable earcups that press against the user's ears for securing to the user's head, and a nose rest to assist in holding the device in its proper position. The Conjurske device includes no positive channel for the liquid, and it relies on the user's head being tilted back to prevent liquid from dripping into the user's eyes. Houston, U.S. Pat. No. 1,524,863, discloses a shampoo shield shaped to admit a user's face and head. However, the Houston device is not self-supporting on the user's head; it must be either manually held to the head, or attached to a fixture where the head is presented to and held against the interior portion of the frame. Paone, U.S. Pat. No. Des. 303,040 discloses a visor that also relies on the user's head being tilted back, due to relatively large brim and only a thin strip of elastic to secure it to the user's head. Seidman, U.S. Pat. 4,368,545 discloses a band encircling the user's head that utilizes an absorbent sponge seal ring next to the user's head, a channel to carry the dripping product to the back of the user's head, and a drain at the back of the channel to carry the solution away from the user's head. Matthews, U.S. Pat. No. 5,940,885, Stepp, U.S. Pat. No. 5,551,088, and Barnes, U.S. Pat. No. 5,146,629 disclose relatively large devices adapted to direct large volumes of water away from the wearer's head to protect the user's face while shampooing and rinsing.

Thus, it is apparent from the known prior art that there is a need for portable, compact, protective device that is suitable for personal shower use, to prevent the dripping of hair conditioner and other hair treatments in the user's eyes, and which addresses or eliminates the drawbacks of the prior protective apparatus of the same general type.

SUMMARY OF THE INVENTION

The general objective of the present invention is to provide a new and improved protective device for use in preventing the dripping of hair treatments onto the user's face and into the user's eyes.

Another general objective of the invention is to provide such a protective device which, while suitable for other uses, is particularly suitable for personal use such as in a shower during application of a hair conditioner.

Yet another objective of the invention is to provide such a protective device that is relatively compact and lightweight, and permits the user to engage in shaving or other cleaning or personal hygiene activities during the duration of the hair treatment.

Still another objective is to provide such a protective device that is durable for reuse, is adapted for user comfort, and is adapted for ease of positioning onto and removal from the user's head by the user.

A detailed objective is to achieve the foregoing by providing a protective headband that includes a resilient base band sized for positioning snugly around the user forehead and past the user's ears without the need for manual fastening devices, a soft, resilient, non-absorbent inner rubber sealing band positioned and shaped to seal against the user's forehead to an area proximate and preferably behind the user's ears, and an integral channel for collecting and directing dripping hair treatments from the user's forehead to behind the user's ears.

These and other objectives and advantages of the invention will become more apparent from the following detailed description when taken in conjunction with the accompanying drawings.

BRIEF DESCRIPTION OF THE DRAWINGS

FIGS. 5 and 6 are cross-sectional views taken along the lines 5—5 and 6—6 of FIG. 4.

FIG. 7 is a fragmentary cross-sectional view taken along the line 7—7 of FIG. 4.

Figure 1:
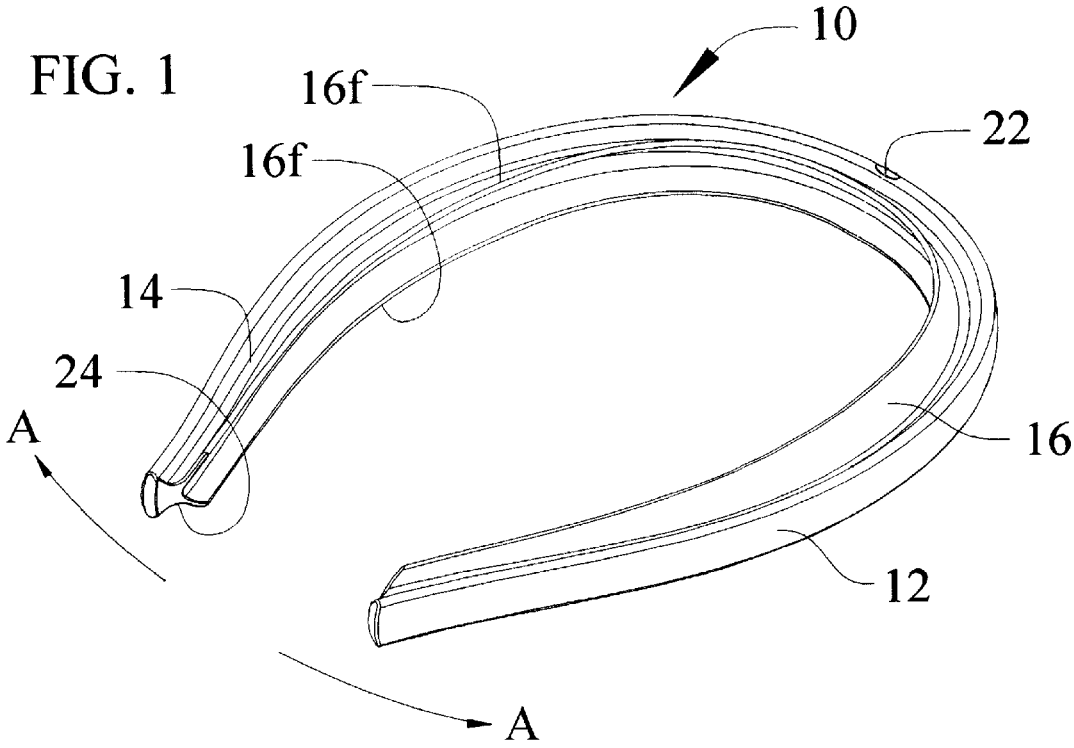
FIG. 1 is a perspective view of a preferred embodiment of a protective headband incorporating the unique aspects of the present invention.
Figure 2:
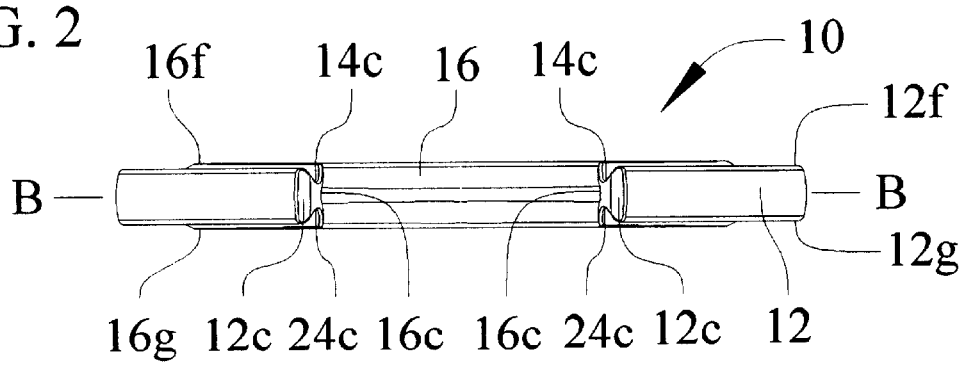
FIG. 2 is a back view thereof.
Figure 3:
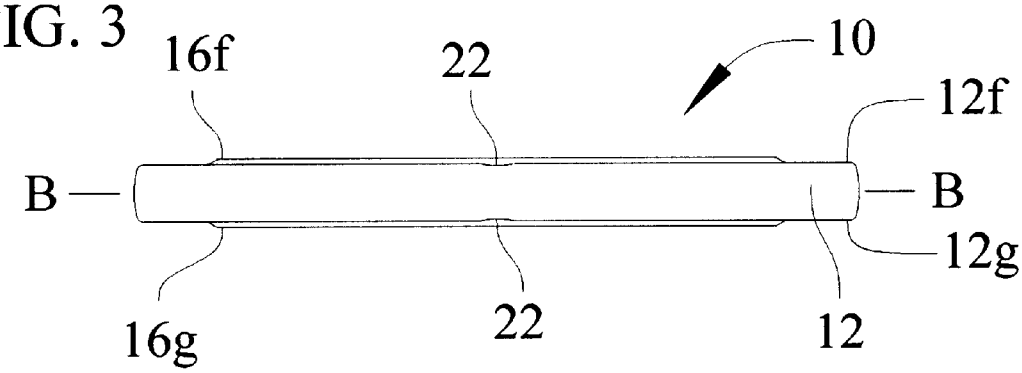
FIG. 3 is a front view thereof.

While the invention is susceptible of various modifications and alternative constructions, certain illustrated embodiments have been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

For purposes of illustration, one embodiment of a protective headband in accordance with the present invention is shown in the drawings as headband 10 (FIGS. 1–8).

Briefly, the headband 10 includes a semi-rigid base band 12 sized to wrap around a user's forehead and extend to behind both ears, a resilient seal band 16 that extends along the base band to seal against the user's forehead, and an upwardly opening channel 14 to catch fluid that drips down the user's forehead and carry the fluid to behind the user's ears.

The base band 12 provides structural support for the headband and is made from a durable, lightweight, water resistant material. In preferred embodiments, the base band is a molded plastic part. One suitable plastic is of the type from which conventional hair-retaining headbands are made.

The base band 12 comprises a generally semi-circular forward portion 12*a* that opens rearwardly (see FIG. 4), and a pair of legs 12*b* that extend rearwardly and inwardly from opposite sides thereof. The legs initiating at positions separated by approximately 180 degrees, and terminating in independent free ends 12*c* to provide an open back, and cooperate with the forward portion to define a general horseshoe shape when viewed from above as in FIG. 4.

The material and cross-sectional configuration of the base band 12 are selected to establish (i) a desired resiliency for ease of opening the legs as indicated by arrows A in FIG. 1, slipping the legs over the user's head and moving the forward portion of the headband into position against the user's forehead, and resilient but comfortable closing of the legs against the sides of the user's head to maintain the band in position thereon, and (ii) a relative stiffness orthogonal thereto to reduce the tendency of twisting as the legs are separated and the headband is positioned on the user's head.

For ease of molding a preferred embodiment, the forward portion 12*a* of the base band 12, and preferably the entire base band, along the associated arc-length thereof extending between the terminating ends 12*c*, is formed with a substantially constant or smoothly transitioning cross-sectional height and thickness.

The base band 12 shown is generally rectangular in cross-section (see FIGS. 4–7), defined between (i) outer and inner surface portions 12*d* and 12*e*, respectively, that extend substantially parallel in cross-section along the basic horseshoe shape therebetween to establish the substantially constant thickness, (ii) top and bottom surface portions 12*f* and 12*g*, respectively, that extend substantially parallel in cross-section and are formed having said horseshoe shape to establish the substantially constant height, and (iii) continuous connecting surface portions 12*h* therebetween such as corners, radii, chamfers, or other corner breaks. In this instance, the base band 12 is relatively thick from top to bottom, and is relatively thin in the radial direction between the outer and inner surfaces. The relative thickness of these cross-sectional parameters is established to achieve the desired resiliency for opening and closing the legs and the desired stiffness from top to bottom to prevent substantial twisting of the legs as the headband is positioned on the user's head.

Alternate suitable cross-sections for the base band will include, but not be limited to, generally oval cross-sections, or generally round cross-sections optionally provided with additional stiffness from top to bottom for added stability against twisting.

The seal band 16 extends lengthwise along the semi-circular arc-length of the forward portion 12*a* of the base band 12, and preferably along the entire arc-length of the base band, terminating at independent ends 16*c* associated with the ends 12*c* of the base band.

The seal band 16 extends radially inwardly and upwardly from one of the inside surface 12*e* of and the top surface 12*f* of the base band 12, terminating in a continuous, inwardly facing upper sealing edge 16f having a semi-circular portion associated with the forward portion 12*a* of the base band and continuing leg portions associated with the leg portions 12*b* of the base band.

The free ends 16*c* of the sealing band 16 are formed with a radius profile when viewed from above (FIG. 4) such that the radial thickness of the ends smoothly decreases upon approaching the base band.

The seal band 16 is made from a relatively soft sealing rubber that conforms to the shape of the object with which it is pressed into contact such that the inner sealing edge 16*f* of the band is brought into and forms sealing engagement with the user's forehead, above the user's temples, and along the top of to behind the user's ears when the headband is positioned on the user's head.

Figure 4:
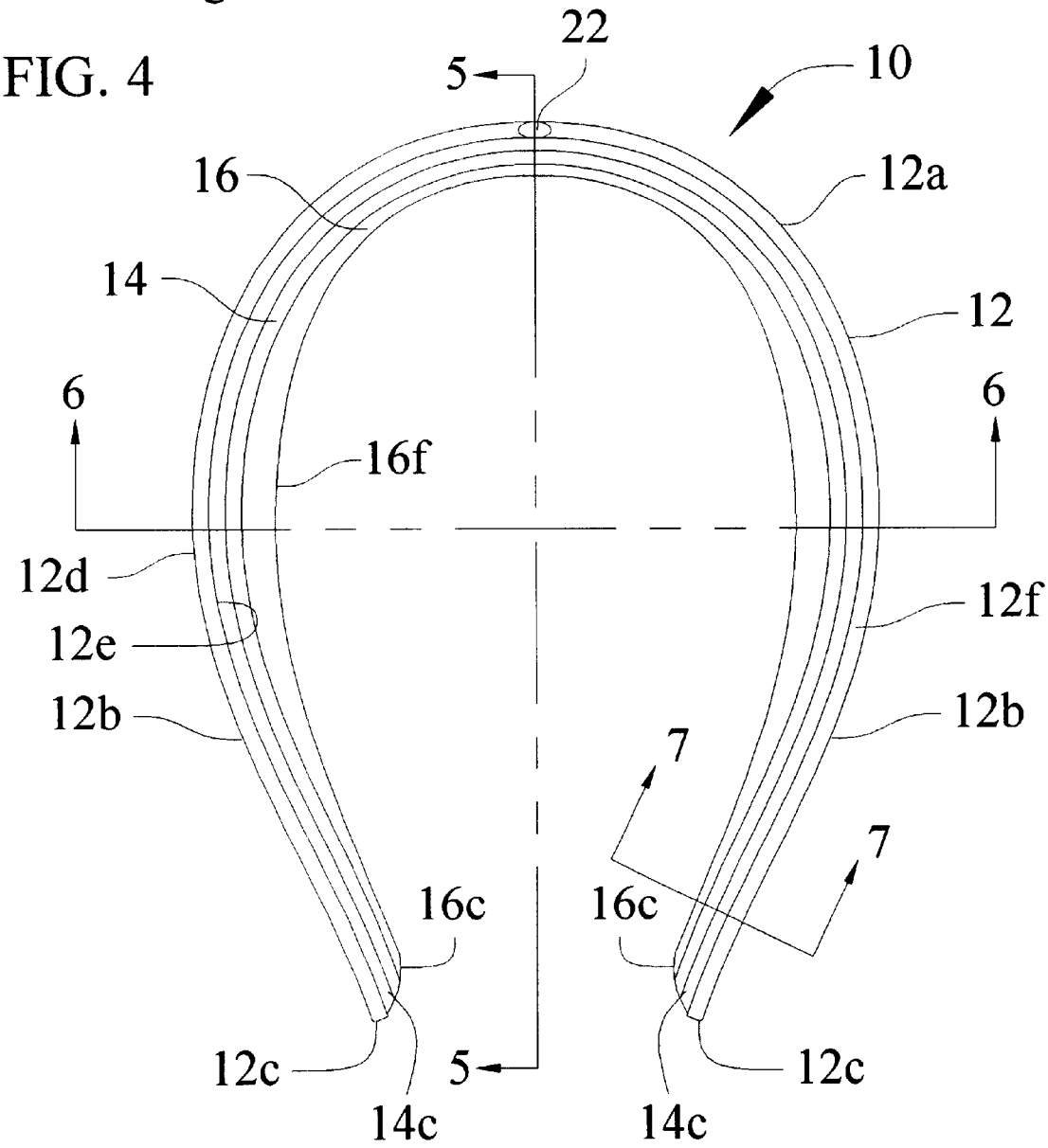
FIG. 4 is a top plan view thereof.
Figure 8:
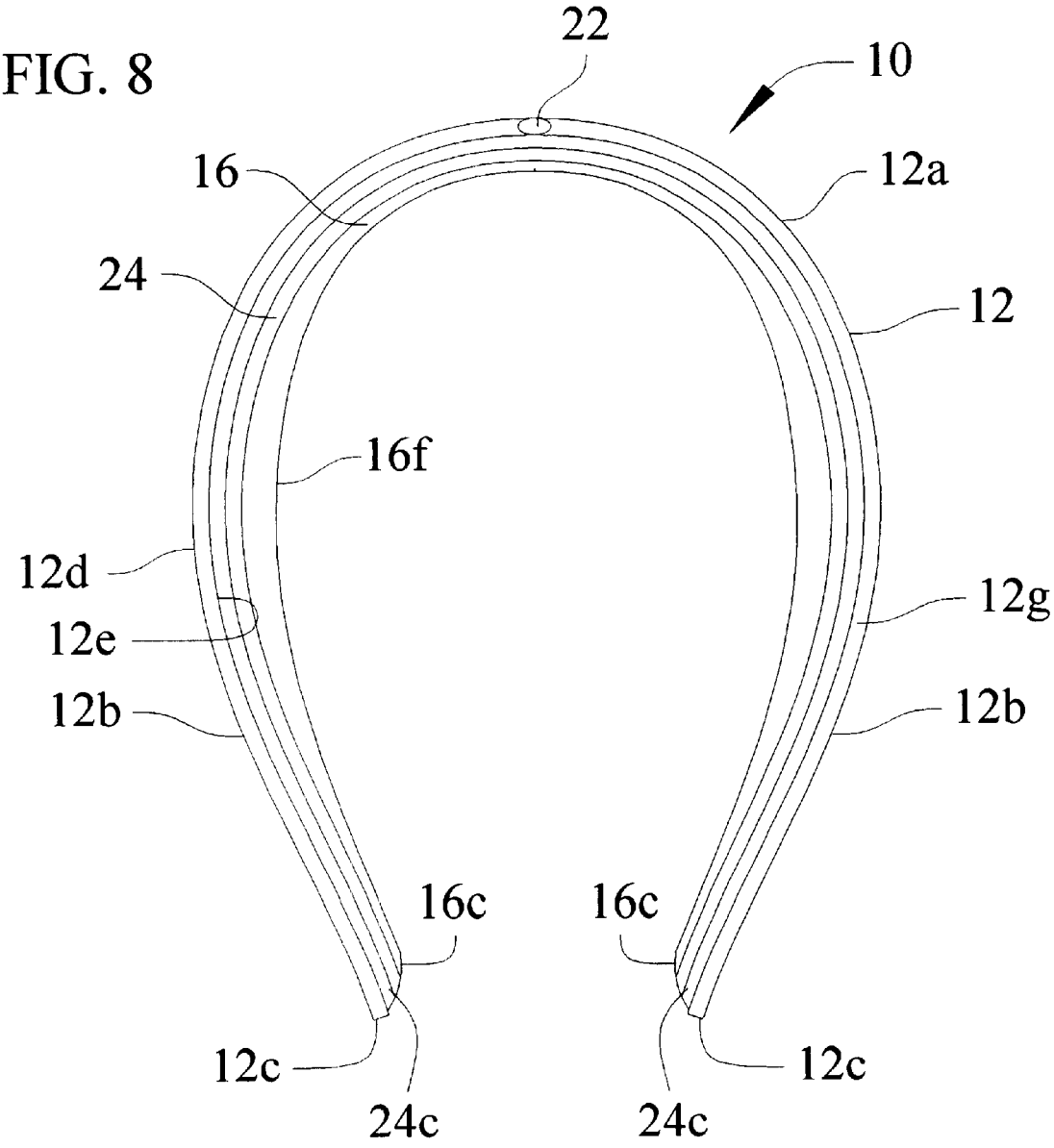
FIG. 8 is a bottom plan view thereof.
Figure 9:
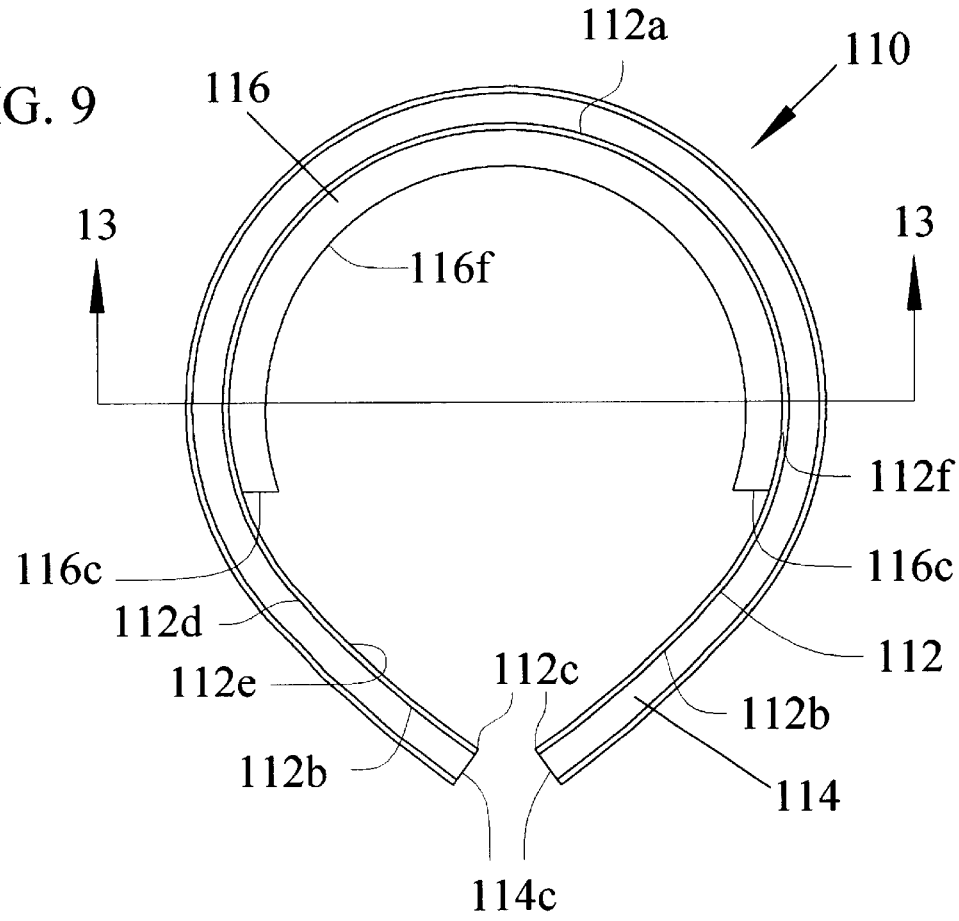
FIG. 9 is a top plan view of an alternate embodiment headband in accordance with the present invention.
Figure 10:
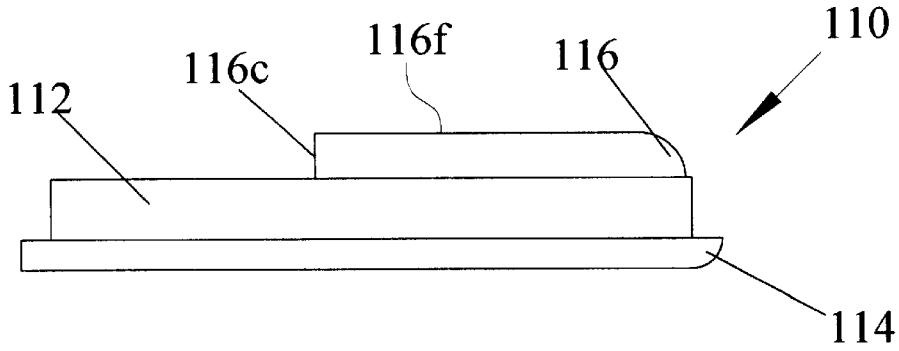
FIG. 10 is a right side elevation view thereof.
Figure 11:
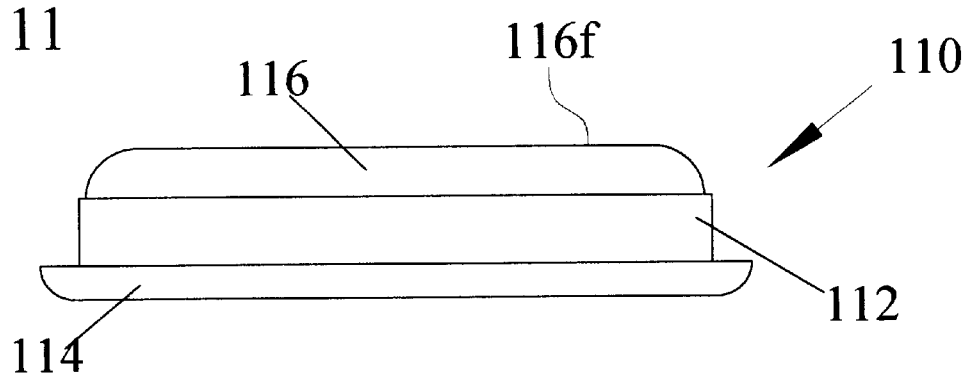
FIG. 11 is a front view thereof.
Figure 12:
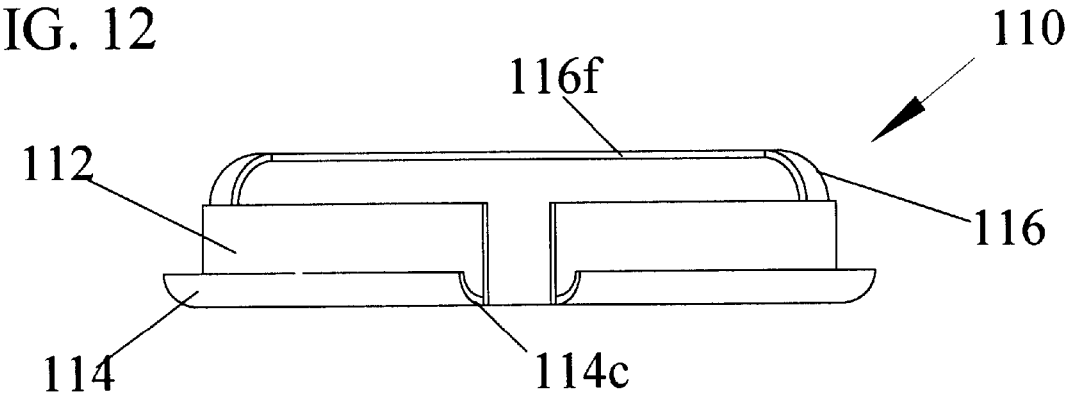
FIG. 12 is a back view thereof.
Figure 13:
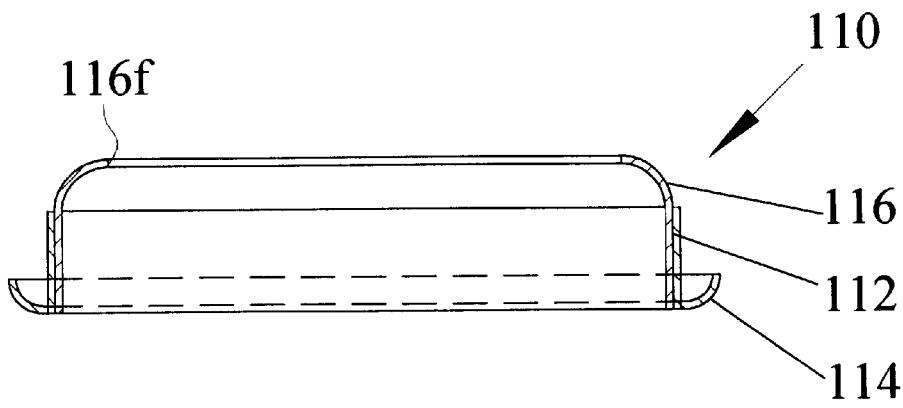
FIG. 13 is a cross-sectional view taken substantially along the line 13—13 of FIG. 9.

The radial thickness of the seal band 16 is relatively constant or smoothly varying such that the sealing edge 16*f* extends substantially parallel to the profile of the base band 12 (see FIG. 4). In the embodiment shown, the sealing band is formed with a thickness that slightly increases towards the two side quadrant portions to assist in conforming to a greater variation of sizes and shapes of potential user's heads. As shown in FIGS. 5–7, the sealing band 16 is also formed with a substantially constant or smoothly transitioning height, and is generally aligned (from top to bottom) with the base band 12. This provides for a stream-lined and relatively compact protective headband.

A lower support band portion 16*g* formed in the seal band 16 extends inwardly approximately the same distance as the sealing edge 16*f* to engage the user's head spaced below the sealing edge. When the headband 10 is positioned on the user's head, the sealing band 16*f* and support band 16*g* portions cooperate to provide a stable, comfortable resting of the headband against the user's forehead, and maintain the profile of the base band generally tracking the profile of the user's head. In the embodiment shown, the upper sealing edge portion 16*f* and the lower support portion 16*g* are provided in the form of opposing tapered portions defining a V-shape in cross-section that extends along the arc-length of the headband, and that resiliently opens for sealing against the user's forehead.

The seal band 16 is preferably a molded rubber part, with the base band 12 and the seal band being formed with a complimentary male and female structure such as the lengthwise-extending tongue 18 and groove 20 (see FIGS. 5–7). The molded seal band is then used as an insert in a mold for molding the base band thereto.

The channel 14 is positioned radially outwardly of the sealing edge 16*f*, extending lengthwise along the entire arc-length of the base band 12, and terminating in open ends 14*c* associated with the ends 12*c* of the base band for positioning behind the user's ears therewith.

The channel 14 is integrally formed in the seal band 16 in a single molded, rubber part such that the channel is positioned between the sealing edge 16*f* and the base band 12, with the sealing edge defining the inside upper edge of the channel. For a given thickness headband, this arrangement provides a compact headband with substantial flexibility in conforming the sealing edge to the user's forehead.

With this arrangement, the headband 10 is quickly and easily positioned onto the user's head in preparation of or following the application of a hair treatment.

The headband may be positioned on the user's head by opening the free ends, slipping them over and past the user's temples until the forward portion of the seal band contacts the user's forehead, with the ends positioned above and behind the user's ears. Upon release of the ends, the legs resiliently close against the sides of the user's head to maintain the headband in position thereon, bringing the edge 16*f* of the sealing band into sealing engagement with the user's forehead and around the user's head from behind one ear to behind the other ear.

Alternately, for example, the headband 10 may be positioned generally horizontally with the curved ends 16*c* of the sealing band 16 against the user's temples, and the headband pressed rearwardly towards and onto the user's head; the pressure causing the ends to resiliently open as they slide along the sides of the user's head to behind the user's ears. The radius profile of the ends of the seal band and the slight flaring-out of the free ends 12*c* of the base band 12 assist in providing for ease of positioning of the headband in this manner.

With the headband 10 in place, at a slight incline downwardly from the forehead to behind the user's ears. If shampoo, conditioner or other hair treatment drips from the user's hair toward his or her forehead, the liquid will drip across the sealing surface 16*f*, down the upper portion of the sealing band 16 and into the channel 14. Upon reaching the channel, the drippage will follow the incline of the channel and flow rearwardly to past the user's ears, drop safely out of the open ends 14*c* of the channel behind the user's ears.

To further assist in ease of positioning the headband onto the user's head, and removal therefrom, the front of the base band 12 shown includes a pair of indentations 22 formed in the top and the bottom surfaces to provide a convenient location for grabbing and pushing or pulling the headband.

Advantageously, the headband 10 shown is formed symmetric about a horizontal plane B—B that extends lengthwise therethrough, from side-to-side and front-to-back. The seal band 16 is positioned centrally along the is height of the base band 12, and is formed with a lower sealing edge 16*g* and downwardly opening channel 24 which mirrors the sealing edge 16*f* and channel 14 with respect to plane B—B (see also FIG. 8). As a result, when the headband is flipped over, the lower sealing edge 16*g* and the channel 24 become an upper sealing edge to seal against the user's forehead and an upwardly opening channel to carry dripping fluid to behind the user's ears. This reversibility promotes ease of usability because orientation is simply removed as a consideration from the thought processes of the user.

An alternate embodiment headband 110 is shown in the drawings in FIGS. 9–13. Except as shown and/or as discussed further below, the headband 110 is similar in structure and function to headband 10. Reference numerals used to identify components and structure of headband 110 correspond to the reference numerals used to identified corresponding components and structure of headband 10, but are incremented by "100".

Briefly, the headband 110 includes a molded plastic base band 112, a molded rubber seal band 116, and an upwardly opening channel 114. The base band includes a forward generally semi-circular portion and a pair of legs that extend rearwardly and inwardly therefrom, terminating in independent free ends and cooperating with the forward portion to define a general horseshoe shape. The cross-sectional profile of the base band is selected to achieve the desired opening, resilient closing, and torsional rigidity characteristics discussed in connection with headband 10.

In this alternate embodiment, the sealing 116 band is formed relatively narrow, tracking along the inside height of the base band 112, and extends radially upwardly and inwardly from the top of the base band toward the center of the headband with a downwardly opening curvature between the base band and the sealing edge 116*f*. The sealing band and sealing edge terminate at end locations 116*c* corresponding to a position proximate the user's ears but forwardly of the ends 112*c* of the base band for ease of positioning the larger sealing edge portion onto the user's head. When the headband 110 is positioned on the user's head, the curvature of this sealing edge portion increases to conform to the user's forehead.

In this instance, the channel 114 is integrally molded with the base band 112 along the lower, outer perimeter thereof. Due to the additional resistance to opening of the legs from the addition of the channel to the outer portion of the base band, the radial thickness of the base band is comparatively decreased as compared with the relative thickness established in the headband 10.

Those skilled in the art will recognize that additional alternate embodiments fall within the scope of the present invention.

From the foregoing, is will be apparent that the present invention brings to the art a new protective device in the form of a compact, portable headband that is uniquely adapted for ease of personal use; to fit snugly in position on a user's head without the need for fasteners, and to protect against dripping of hair treatments into the user's face and eyes by collecting and re-directing the dripping liquid to behind the user's ears, without the need to completely restrict the user's head, and thus enabling the user to continue with other cleaning activities for the time period during which the treatment remains in the user's hair.

I claim:

1. A protective headband adapted to be placed over a user's forehead to prevent dripping of liquid hair treatments from the user's hair into the user's eyes, the headband comprising:

a semi-rigid, resilient base band formed having a forward generally semi-circular portion for positioning around the user's forehead and two legs extending rearwardly and inwardly therefrom from opposite sides thereof, the legs terminating in independent free ends for resiliently opening and positioning against the user's head above and behind the user's ears;

a sealing band extending along said forward portion of said base band for positioning around the user's forehead therewith, the sealing band having a generally semi-circular inwardly facing first sealing surface portion positioned inwardly of said base band and adapted to seal against the user's forehead; and an upwardly opening channel extending along the base band outwardly of said first sealing surface portion, the channel having independent open terminating ends associated with the ends of the base band for positioning behind the user's ears therewith such that drippage from the user's hair will travel over said sealing surface portion down the sealing band and into the channel for discharging from the open ends of the channel behind the user's ears.

2. The protective headband as defined in claim 1 in which one of (i) said base band along the arc-length thereof between said terminating ends, and (ii) said forward portion of said base band along the semi-circular arc-length thereof, is provided with a generally constant thickness defined by generally parallel inside and outside surfaces.

3. The protective headband as defined in claim 2 in which said sealing surface portion of said sealing band extends generally parallel with said inside and outside surfaces of said one.

4. The protective headband as defined in claim 1 in which one of (i) said base band along the arc-length thereof between said terminating ends, and (ii) said forward portion of said base band along the semi-circular arc-length thereof, is formed with a substantially constant cross-section.

5. The protective headband as defined in claim 4 in which said one is provided, extending along the associated arc-length thereof, with a generally rectangular cross-section defined between (i) generally parallel top and bottom surfaces and (ii) generally parallel inside and outside surfaces interconnected therebetween.

6. The protective headband as defined in claim 5 in which the cross-sectional distance between said top and bottom surfaces is substantially greater than the cross-sectional distance between said inside and outside surfaces.

7. The protective headband as defined in claim 1 in which the height of said base band and the height of said sealing band are substantially constant along the associated arc-lengths thereof.

8. The protective headband as defined in claim 7 in which said base band and said sealing band are generally aligned with respect to said heights.

9. The protective headband as defined in claim 8 in which said base band and said sealing band are of approximately equal height.

10. The protective headband as defined in claim 1 in which said sealing band extends generally along the arc-length of the base band such that the terminating ends of the sealing band are associated with the terminating ends of the base band for positioning behind the user's ears.

11. The protective headband as defined in claim 10 in which said base band includes an inside surface extending along the arc-length thereof, and said sealing band is connected to and extends inwardly to said sealing surface portion from said inside surface.

12. The protective headband as defined in claim 1 in which the channel is positioned inwardly of said base band.

13. The protective headband as defined in claim 12 in which said channel is integrally formed in said sealing band.

14. The protective headband as defined in claim 1 in which said channel is positioned outwardly of said base band.

15. The protective headband as defined in claim 14 in which said channel is integrally formed in said base band.

16. The protective headband as defined in claim 1 in which the base band and the sealing band are symmetric about a plane extending centrally lengthwise therethrough such that the headband further comprises a second sealing surface portion mirroring said first sealing surface portion, and a downwardly opening channel mirroring said upwardly opening channel about said plane such that the headband is reversible about said plane.

17. A protective headband adapted to be placed over a user's forehead to prevent dripping of liquid hair treatments from the user's hair into the user's eyes, the headband comprising:

a molded plastic, generally horseshoe shaped base band defined by a forward generally semi-circular portion and two legs extending rearwardly and inwardly therefrom, the legs having independent terminating free ends for resiliently opening and positioning of the forward portion around the user's forehead and the terminating free ends against the user's head above and behind the user's ears, a molded rubber sealing band connected along the base band for positioning around the user's forehead therewith, the sealing band extending inwardly from the base band and terminating therein in an inwardly facing sealing surface portion adapted to seal against the user's forehead; and an upwardly opening channel (i) integrally molded in one of the base band and the sealing band and (ii) extending along the arc-length of base band outwardly of said sealing surface portion, the channel having open ends associated with the terminating free ends of the base band such that drippage from the user's hair will travel over said sealing surface portion down the sealing band and into the channel for discharging from the open ends of the channel behind the user's ears.

18. The protective headband as defined in claim 17 in which the forward portion of said base band is molded having, along the arc-length thereof, at least one of (i) generally parallel inside and outside surfaces to define a substantially constant thickness and (ii) generally parallel top and bottom surfaces to define a substantially constant height.

19. The protective headband as defined in claim 17 in which the channel is integrally molded in the sealing band and the sealing band extends along the arc-length of the base band to terminating ends positionable behind the user's ears.

20. The protective headband as defined in claim 17 in which the base band and the sealing band are symmetric about a plane extending centrally lengthwise therethrough such that the headband further comprises an integrally molded downwardly facing channel mirroring the upwardly facing channel and a downwardly extending sealing band mirroring the upwardly extending seal band such that the headband is reversible about said plane.

21. A protective headband adapted to be placed over a user's forehead to prevent dripping of liquid hair treatments from the user's hair into the user's eyes, the headband comprising:

a semi-rigid, resilient base band formed having a forward generally semi-circular portion for positioning around the user's forehead and two legs extending rearwardly and inwardly therefrom from opposite sides thereof, the legs terminating in independent free ends for resiliently opening and positioning against the user's head above and behind the user's ears;

a soft, resilient sealing band extending along said base band for positioning around the user's forehead therewith, the sealing band having (i) an upper sealing surface portion extending inwardly of said base band and adapted to seal against the user's forehead, and (ii) a lower surface portion extending inwardly of said base band for resting against the user's forehead; and an upwardly opening channel extending along the base band outwardly of the sealing surface portion of said sealing band, said channel having independent open terminating ends associated with the ends of the base band such that drippage from the user's hair will travel over said sealing surface portion down the sealing band and into the channel for discharging from the open ends of the channel behind the user's ears.

* * * * *